United States Patent [19]

Dilo

[11] Patent Number: 4,481,694

[45] Date of Patent: Nov. 13, 1984

[54] FLEECE LAYERING APPARATUS

[75] Inventor: Johann P. Dilo, Eberbach, Fed. Rep. of Germany

[73] Assignee: Oskar Dilo Maschinenfabrik KG, Eberbach, Fed. Rep. of Germany

[21] Appl. No.: 392,689

[22] Filed: Jun. 28, 1982

[30] Foreign Application Priority Data

Jul. 1, 1981 [DE] Fed. Rep. of Germany ..... 3125946

[51] Int. Cl.[3] ..... B65H 45/103

[52] U.S. Cl. ..... 19/296; 19/163; 19/302

[58] Field of Search ..... 19/296–308, 19/161.1, 163

[56] References Cited

U.S. PATENT DOCUMENTS

| | | | |
|---|---|---|---|
| 3,638,279 | 1/1972 | Swados | 19/163 |
| 3,877,628 | 4/1975 | Asselin et al. | 19/163 X |
| 3,973,291 | 8/1976 | Kolbach | 19/301 X |
| 4,074,395 | 2/1978 | Frosch et al. | 19/163 |
| 4,194,270 | 3/1980 | Hille | 19/163 |
| 4,290,170 | 9/1981 | Brookstein et al. | 19/308 X |

*Primary Examiner*—Louis Rimrodt

*Attorney, Agent, or Firm*—Daniel M. Rosen

[57] ABSTRACT

Fleece layering apparatus for forming a fibrous fabric web consisting of several layers of fleece with delivery means layering the infed fleece in a zig-zag manner, with which the infed fleece is moved by air-permeable delivery means against the surface of which the web of fleece is pressed by a controlled and regulated air flow, and with an upper fixed air-permeable delivery belt and a lower fixed air-permeable delivery belt vertically spaced beneath the upper one and parallel to it, between which a preferably air-permeable fleece transferring roll is provided which can move backwards and forwards between two end positions, and beneath the lower delivery belt, a fleece doffing and cuttling device is provided which can move backwards and forwards between two end positions.

8 Claims, 3 Drawing Figures

FLEECE LAYERING APPARATUS

BACKGROUND OF THE INVENTION

The invention refers to a fleece layering apparatus for forming a fibrous fabric web consisting of several layers of fleece, with delivery means depositing the infed web of fleece, made up of textile fibers, in a zig-zag manner onto a moveable support or on a web of fleece already laid on the support, said means being arranged on a carriage which can reciprocate between two end positions, and with delivery belts supporting the continuously infed fleece, transporting it and storing it at intervals.

Two types of fleece layering devices have been used hitherto for the production of fibrous fabric webs, these being the vertical-arm layering apparatus or the camel-hump crosslayering device, where the infed fleece is transported by delivery belts to a position high above the fibrous web to be formed and then transported by two delivery belts downwards to a carriage swinging in back and forth motion above the fibrous web, said carriage having cuttling rollers.

Fleece layering devices of this type have a range of disadvantages. On the one hand the reciprocating mass is relatively large which means that the performance is limited and on the other hand a fiber ridge forms on the edges of the fibrous web, as, at the reversing points of the carriage, during the back and forwards motion, the web of fleece is fed in at a constant speed, whereas the carriage is, at this point, stationary for a moment, and before and after this point has a delay and acceleration phase. Furthermore, at the changeover points of the fleece from one delivery belt to the other, the fleece is stretched and upset which leads to inhomogeneity of the fleece.

The second type of fleece layering device is the flat layering device which has a smaller structural height. The disadvantages with these fleece layering devices is the relatively large mass which has to undergo reciprocal motion. These devices have the advantage over the vertical-arm layering apparatus in that the fleece stretching and upsetting is slighter, however the formation of edge ridges is still not avoided.

With an improved flat cuttling device of the type in question, the web of fleece, from the infeeding to the output point, is led in a constant manner between two parallel arranged delivery belts, thus protecting the fleece which is sensitive to air turbulences, and thus enabling high delivery speeds. Furthermore, the fleece discharge speed is so controlled that it is zero at the reversing points of the carriage, so as to avoid thickening in the area of the fibrous fabric web edges. These flat layering devices however have the very great disadvantage that they require a great mechanical expenditure and large masses still have to undergo reciprocal motion. This is seen in particular in that the delivery belts guiding the web of fleece are usually 2.5 meters in width. This can have the disadvantageous effect in operation that, particularly during high speeds, air is drawin in between the belts forming air pockets which impair the bond of the fleece and cause defects.

SUMMARY OF THE INVENTION

The invention is based on the task of suggesting a new type of fleece layering apparatus, of flat design, which avoids the aforementioned disadvantages of the known fleece layering devices and which permits a very high working speed with improved quality of the produced fibrous fabric web.

For solving this task, it is suggested according to the invention, that the infed web of fleece is moved via air-permeable delivery means against the surface of which the web of fleece is pressed using a controllable air flow.

This measure means that practically half of the hitherto required delivery means for the guiding and supporting of the web of fleece can be done without. Furthermore, the web of fleece undergoes a more protective handling on its path through the machine to the layering position and its homogeneity remains practically unaltered.

Preferably the air flow pressing the fleece against the surface of the delivery means is produced by a vacuum present on the rear side of the delivery means.

With the suggested fleece layering apparatus of flat design according to the invention, there are two air-permeable delivery belts spaced one above the other in a fixed rest position—i.e. they do not carry out any translatory reciprocating motion. The transmission of the fleece from the first upper delivery belt to the second delivery belt lying beneath it, takes place via a fleece transferring roll which is moved backwards and forwards between two end positions between the two delivery belts, from the lower delivery belt the fleece is taken off by a reciprocating fleece doffing and cuttling device and layered in the common manner. Thus the translatory reciprocating mass consists only of the fleece transferring roll moved backwards and forwards between the two delivery belts and the reciprocated fleece doffing and cuttling device.

BRIEF DESCRIPTION OF THE DRAWINGS

Further features can be seen from the sub-claims and the subsequent description of a preferred embodiment of a fleece layering apparatus formed according to the invention. The drawings show:

DETAILED DESCRIPTION OF THE DRAWINGS

Figure 1:
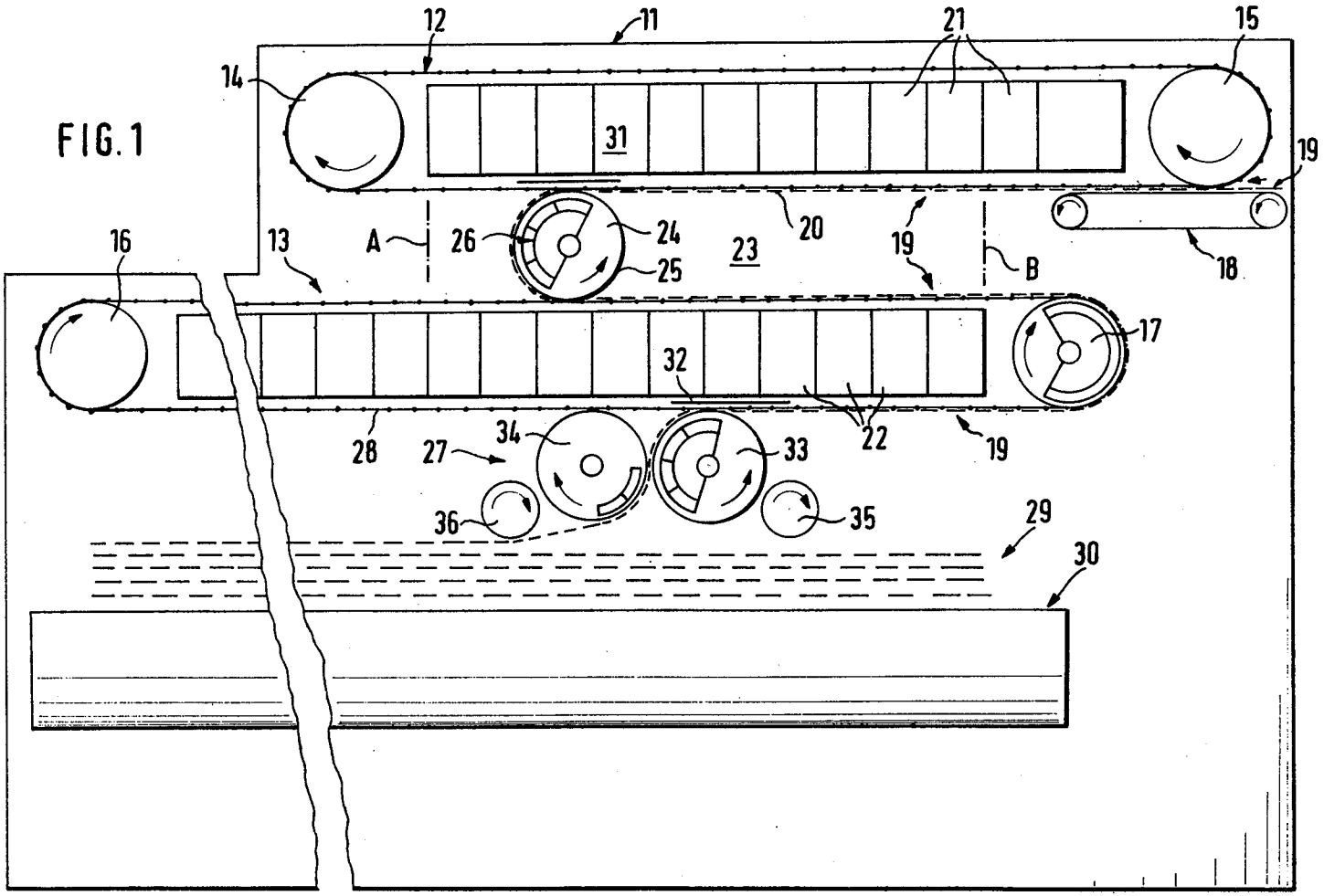
FIG. 1 a side view or longitudinal section resp. of a fleece layering apparatus according to the invention in a schematic representation.

As FIG. 1 shows, the layering device 11 of the fleece layering apparatus consisting of two horizontal, parallel endless belts 12 and 13 spaced apart from each other, which are permeable to air and led over the guide rollers 14, 15 or 16, 17 respectively. The delivery belts 12 and 13 can be of multivarious design. They can be made of a mesh netting, a perforated metal sheet, a bar grate or other suitable material.

Beneath the infeed end of the upper delivery belt 12 is arranged another delivery belt 18 with which the fleece 19 to be layered is continuously fed to the lower strand 20 of the upper delivery belt 12. Between the top and bottom strand of the upper and lower delivery belt 12, 13 are situated a number of parallel vacuum chambers 21, 22 respectively, arranged side by side, which are open on the sides in question facing the delivery belts, or they have openings, and create an air flow in a direction towards the delivery belts, through which the web of fleece is carefully pressed against the surface of the delivery belts.

In order to transfer the web of fleece 19 from the bottom strand 20 of the upper delivery belt 12 to the top strand 23 of the lower delivery belt 13, a fleece transferring role 24 is provided between the delivery belts, which preferably also has an air-permeable surface 25 behind which is situated a vacuum chamber 26 extending over at least a part of the periphery carried by the shaft of the roll 24. The fleece transferring roll 24 can be moved backwards and forwards between two end positions A and B.

Via the lower delivery belt 13 revolving periodically, however always in the same direction, the fleece lying on the top strand 23 is led to the lower side where it is, on the one hand taken off the bottom strand 28 of the lower delivery belt 13 by the fleece doffing and cuttling means 27, and during the back and forwards motion of the carriage of the fleece doffing and cuttling device 27 it is laid down on the already formed layers of the fibrous fabric web 29 which lies on a delivery belt 30 which is moved in a cross or lengthwise direction towards the layering apparatus 11.

The vacuum in the vacuum chambers can be controlled and regulated so as to obtain a desired air flow. Particularly at those points where the web of fleece is taken off the delivery belt on which it is carried, the air flow in this area must either be reduced or interrupted, this taking place through reduction or cut-off of the vacuum, or also through covering up the openings of the vacuum chambers, for example with a cover plate 31 or 32 respectively, which is effected by the thereto associated mobile elements between the delivery belt 12 and 13 and the vacuum chambers 21 and 22 respectively.

While the infeed delivery belt 18 and also the upper delivery belt 12 are always moved at a constant speed and in the same direction, the lower delivery belt 13 is controlled intermittently and moved in the opposited direction.

Figure 2:
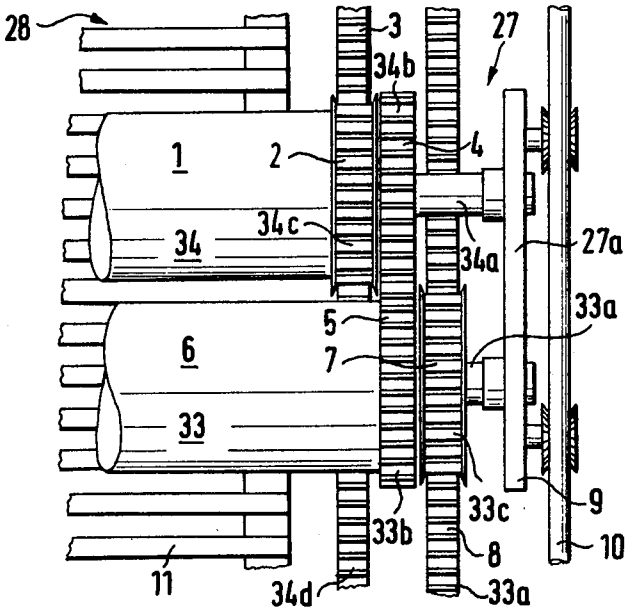
FIG. 2 a view from below of a part of the fleece doffing and cuttling device in the area of the drive mechanism.

Both the upper and the lower delivery belts 12, 13 are kinematically coupled with the fleece transferring roll, this expediently taking place via toothed belts, roller chains or such, revolving synchronously with the delivery belts, and a gear mating with said belts or chains, said gear being coupled with the fleece transferring roll, as is also the case regarding the drive mechanism shown in FIG. 2 of the fleece doffing and cuttling device 27.

From FIG. 2 which shows a view onto the bottom side of the fleece doffing and cuttling device 27, its drive mechanism is shown. The fleece doffing and cuttling device 27, which can reciprocate beneath the strand 28 of the lower delivery belt 13, consists of a carraige 27*a* running on rails, on which two rolls 33 and 34 are rotatably mounted. The rollers 33 and 34 are coupled together via mating gears 33*b*, 34*b* seated on the shafts 33*a*, 34*a* of the rolls, and they turn in opposite direction to each other. Their drive as well as that of the carriage 27*a* takes place via gears 33*c*, 34*c* connected with the rolls 33 and 34 respectively, which mate with the two staggered endless revolving, alternately driven toothed belts 33*d* and 34*d* respectively. The drive of the two toothed belts 33*d* and 34*d* can take place via a gearing mechanism.

The mode of operation of the fleece layering apparatus formed according to the invention is as follows: The fleece transferring roll 24 is in position B and the lower delivery belt 13 is stationary. The fleece 19 is fed to the bottom strand 20 of the upper delivery belt 12 which is moving at a constant speed, via the infeed belt 18. During this infeed of the web of fleece, the fleece transferring roll 24 moves to the left until it reaches the end position A. When it reaches A, the lower delivery belt 13 is set into motion. Here the fleece transfer roll 24 transfers the fleece to the top strand 23 of the lower delivery belt 13, which brings the web of fleece to the bottom side of the bottom strand 28. If the fleece doffing and cuttling device 27 is in its left position, then, during its moving to the right end position, the roll 33 takes up the web of fleece 19 from the bottom strand of the lower delivery belt 13, said fleece then being laid down on the top layer of the fibrous fabric web 29 by the second roll 34. Here the lower delivery belt 13 is stationary. When reaching the right end position, the motion of the doffing and cuttling device 27 is reversed, so that it then moves towards the left end position. Thereupon, the lower delivery belt 13 moves and the web of fleece 19 is taken off it by the roll 33 and is laid down to form a further layer.

The layer of fleece laid down by the doffing and cuttling device 27 is expediently pressed against the fibrous fabric web 29 by pressure rolls 35, 36.

Figure 3:
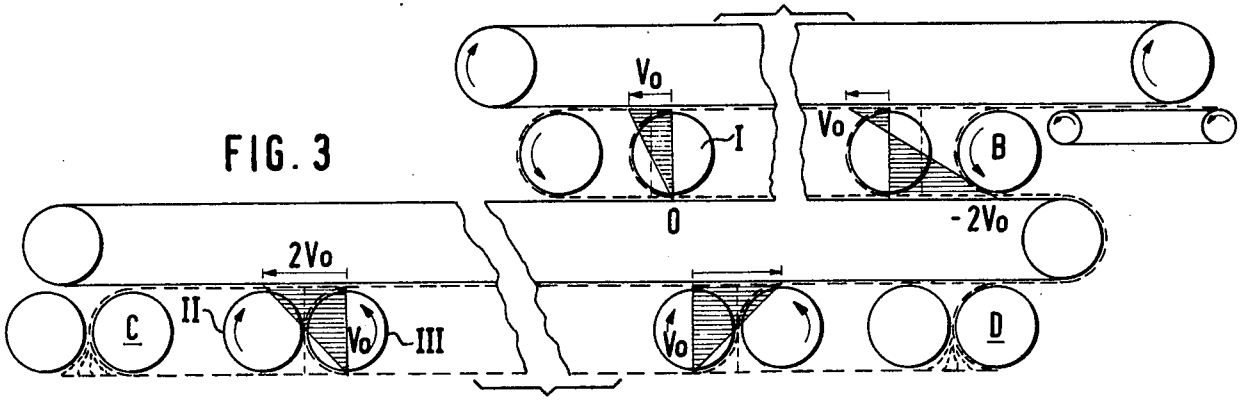
FIG. 3 movement sequence diagram.

The kinematic conditions with the fleece layering apparatus according to the invention are shown in FIG. 3. They are futhermore described as follows:

The upper delivery belt 12 revolves constantly at $V_o$=constant

The transferring roll 24 rotates only in anticlockwise direction, during its motion towards the left the translational speed is $+\frac{1}{2}$ $V_o$, its peripheral speed $\omega.r$ is also $\frac{1}{2}$ $V_o$.

During the moving of the transferring roll 24 towards the left, the lower deliver belt 13 is stationary.

During the moving of the transferring roll 24 to the right, the lower delivery belt 13 moves at a speed of 2 $V_o$.

The translational speed of the transferring roll 24 is $\frac{1}{2}$ $V_o$, its peripheral speed corresponds to $1\frac{1}{2}$ $V_o$.

The pair of rolls 33, 34 move with the speed $+V_o$ to the left and $-V_o$ to the right. The rolls 33, 34 always rotate in opposite directions with the peripheral speed of $V_o$.

What is claimed is:

1. In a fleece layering apparatus for forming a fibrous fabric web consisting of several layers of fleece, and having delivery means depositing the input web of fleece, said web made up of textile fibers in a zig-zag manner, onto a movable support or onto a web of fleece already laid on the support, said delivery means being arranged on a carriage which can reciprocate between two end positions, and with delivery belts supporting the continuously input fleece, transporting it and storing it at intervals, the improvement therein being:

an upper, fixed, air-permeable, endless delivery belt looped around spaced apart rollers;

vacuum chambers, having controllable degrees of vacuum above the lower strand of said upper belt, vacuum from said vacuum chambers drawing said fleece web against the bottom side of said lower strand;

a lower, fixed, air-permeable, endless delivery belt running parallel to said upper belt and looped around spaced apart rollers;

vacuum chambers with controllable degrees of vacuum located above the lower strand of said lower delivery belt, the vacuum from said chambers drawing the adjacent portion of said fleece web against the bottom side of said lower strand;

a fleece transferring roll positioned between said two delivery belts, said fleece transferring roll being reciprocable between two end positions, said roll being adapted to attract and hold said web thereto;

a fleece doffing and cuttling device located beneath said lower delivery belt, said doffing and cuttling device being reciprocable between two end positions.

2. A fleece layering apparatus according to claim 1, wherein said fleece transferring roll is permeable and includes vacuum means for attracting said fleece web by drawing through said permeable transferring roll.

3. Fleece layering apparatus according to claim 1 wherein the degree of vacuum is locally variable and the vacuum holding the web of fleece on the surface of the bottom strands of the delivery belts is cut off in the effective area of the fleece transferring roll and the fleece doffing device by reducing the suction of or cutting off the associated vacuum chambers.

4. Fleece layering apparatus according to claim 1 wherein the upper delivery belt, taking up with its bottom strand the web of fleece delivered at a constant speed, is always driven in the same direction and with a constant speed.

5. Fleece layering apparatus according to claim 4 wherein the lower delivery belt can be driven periodically in the opposite direction to that of the upper delivery belt.

6. Fleece layering apparatus according to claim 4 or 5 wherein the upper and lower delivery belt are both kinematically coupled with the fleece transferring roll.

7. Fleece layering apparatus according to claim 6 wherein the coupling of the delivery belts to the fleece transferring roll takes place via toothed belts, roller chains or the like, synchronously revolving with the delivery belts and a gear mating with said belts or chains, said gear also being coupled to the fleece transferring roll.

8. Fleece layering apparatus according to claim 6, wherein the fleece doffing and cuttling device consists of two parallel rolls coupled together via gears, said device being mounted on a carriage which can reciprocate beneath the lower delivery belt, said rolls being brought into motion by gears connected thereto and toothed belts or chains mating with said gears respectively, said belts or chains being alternately driven.

* * * * *